US011425942B2

(12) United States Patent
Mack

(10) Patent No.: US 11,425,942 B2
(45) Date of Patent: Aug. 30, 2022

(54) DIAPER COVER

(71) Applicant: Selena Mack, Boise, ID (US)

(72) Inventor: Selena Mack, Boise, ID (US)

( * ) Notice: Subject to any disclaimer, the term of this patent is extended or adjusted under 35 U.S.C. 154(b) by 0 days.

(21) Appl. No.: 14/079,363

(22) Filed: Nov. 13, 2013

(65) Prior Publication Data

US 2014/0130236 A1 May 15, 2014

Related U.S. Application Data

(60) Provisional application No. 61/725,897, filed on Nov. 13, 2012.

(51) Int. Cl.
*A41D 11/00* (2006.01)
*A41B 9/12* (2006.01)

(52) U.S. Cl.
CPC ..... *A41D 11/00* (2013.01); *A41B 9/12* (2013.01)

(58) Field of Classification Search
CPC ..... A41D 11/00; A41D 13/1254; A41D 9/12; A41D 27/12; A41B 9/14; A41B 13/00; A41B 3/04; A41B 9/008; A41B 2300/32; A41B 2300/322; A41B 2300/324; A41B 2300/326; A41B 2300/33; A41B 2300/332
USPC ..... 2/236, 237, 231, 232, 75, 111
See application file for complete search history.

(56) References Cited

U.S. PATENT DOCUMENTS 183,787 A * 10/1876 Woodward ..... A41F 9/02 2/237
210,713 A * 12/1878 Schollian ..... A41F 9/02 2/237
722,138 A * 3/1903 Peak ..... A41F 9/02 2/237
747,809 A * 12/1903 Velasko ..... A41B 9/001 2/237
849,060 A * 4/1907 Friedbaum ..... A41F 9/00 2/235
1,016,538 A * 2/1912 Ashworth ..... A61F 13/496 2/237
1,174,976 A * 3/1916 Gaines ..... A41D 1/20 2/221
1,201,307 A * 10/1916 Joseph ..... A41B 13/04 2/402
1,293,704 A * 2/1919 Cavanagh ..... A41F 9/02 2/237
1,307,959 A * 6/1919 Chase ..... A41B 13/00 2/80
1,397,579 A * 11/1921 Guinzburg ..... A41B 13/04 2/401
1,544,312 A * 6/1925 Gray ..... A41B 13/045 156/163
1,555,380 A * 9/1925 Pfeiffer ..... A41F 9/025 2/221

(Continued)

*Primary Examiner* — Alissa L Hoey
(74) *Attorney, Agent, or Firm* — Scott D. Swanson; Shaver & Swanson, LLP

(57) ABSTRACT

A diaper cover to prevent access to diaper contents by the wearer. The diaper cover has tight fitting closures around each leg of the user and a rear-access waist adjustment system. The waist adjustment system can utilize a belt type system with Velcro or a buckle, although other similar systems can be used. Access to the waist adjustment system by the wearer is prevented by using a flap that is secured in place over the adjustment system by attachment devices, such as buttons or snaps.

15 Claims, 4 Drawing Sheets

(56) References Cited

U.S. PATENT DOCUMENTS 1,616,640 A * 2/1927 Sprague ..... A41D 1/06 2/221
1,652,914 A * 12/1927 Snell ..... A41F 9/02 2/220
1,729,265 A * 9/1929 George ..... A41B 9/14 2/237
1,735,657 A * 11/1929 Sacks ..... A41F 9/02 2/221
1,744,710 A * 1/1930 Surkin ..... A41F 9/02 2/237
1,821,818 A * 9/1931 Snyder ..... A41D 1/06 2/227
1,823,296 A * 9/1931 Sekey ..... A41F 9/02 2/221
1,825,271 A * 9/1931 Karberg ..... A41F 9/025 2/237
1,891,884 A * 12/1932 Tanner ..... A41B 9/004 2/237
1,966,651 A * 7/1934 Snader ..... A41B 9/04 2/237
2,085,913 A * 7/1937 Lipton ..... A41F 9/02 2/237
2,092,152 A * 9/1937 Daniel ..... A41D 7/005 2/237
2,156,206 A * 4/1939 Takahashi ..... A41D 1/06 2/123
2,200,090 A * 5/1940 Konski ..... A41B 9/14 2/237
2,427,637 A * 9/1947 Verti ..... A41F 9/025 2/237
2,444,020 A * 6/1948 Markin ..... A41F 1/006 2/235
2,450,631 A * 10/1948 Buchler ..... A41D 11/00 2/406
2,786,208 A * 3/1957 Oberg ..... A41F 17/00 2/232
2,824,560 A * 2/1958 Clinton ..... A41D 7/005 2/67
2,854,670 A * 10/1958 Naccash ..... A41F 9/025 2/221
3,599,640 A * 8/1971 Larson ..... A61F 13/496 2/403
3,601,130 A * 8/1971 Saltiel ..... A41B 9/14 2/407
4,011,600 A * 3/1977 Malk ..... A42C 5/02 2/183
4,397,646 A * 8/1983 Daniels ..... A61F 13/49004 604/381
4,893,358 A * 1/1990 Bice, Jr. ..... A41F 9/025 2/221
5,048,122 A * 9/1991 Prieur ..... A41D 13/1272 2/111
5,050,244 A * 9/1991 Kleinman ..... A41D 1/067 2/227
5,418,978 A * 5/1995 Hochman ..... A41D 13/1263 2/114
5,598,586 A * 2/1997 Munjone ..... A41D 1/08 2/228
5,762,619 A * 6/1998 Simon ..... A61F 5/028 2/312
6,138,282 A * 10/2000 Follese ..... A41B 9/14 2/220
6,260,200 B1 * 7/2001 Alfred ..... A41D 13/1263 2/69
6,678,898 B2 * 1/2004 Jones ..... A41F 9/00 2/321
6,748,606 B1 * 6/2004 Silverstein ..... A42B 1/22 2/181.4
6,779,201 B1 * 8/2004 Pfrommer ..... A44B 11/006 2/321
6,954,946 B2 * 10/2005 Goldfarb ..... A41F 9/002 2/338
8,429,762 B2 * 4/2013 Weisman ..... A41D 7/00 2/237
8,468,658 B1 * 6/2013 Rife ..... A41F 9/002 24/182
2007/0028364 A1 * 2/2007 Oomae ..... A41F 9/025 2/237
2009/0070910 A1 * 3/2009 McNally ..... A41D 13/04 2/23
2009/0139014 A1 * 6/2009 Trochlil-Crist ..... A41F 9/002 2/338
2010/0275344 A1 * 11/2010 Demarest ..... A41F 9/00 2/237
2011/0296585 A1 * 12/2011 Jenkins ..... A61F 13/84 2/221
2012/0180194 A1 * 7/2012 Cutter ..... A41F 9/025 2/237
2012/0210495 A1 * 8/2012 Wilson ..... A41F 9/025 2/236
2012/0246791 A1 * 10/2012 Weisman ..... A41D 7/00 2/67
2013/0031698 A1 * 2/2013 Valles ..... A41F 9/00 2/221

* cited by examiner

DIAPER COVER

PRIORITY/CROSS-REFERENCE TO RELATED APPLICATIONS

This application claims the benefit of U.S. Provisional Application No. 61/725,897, filed Nov. 13, 2012, the disclosure of which is incorporated by reference.

TECHNICAL FIELD

The presently disclosed and claimed inventive concepts generally relate to a system for securing diapers, and more particularly to garments that go over diapers to prevent access to the diaper by the wearer.

BACKGROUND

There are individuals that "diaper dive" for any number of reasons, such as age, mental competence, or mental disorder. Diaper diving involves the wearer of a diaper reaching into his diaper and accessing, and often removing, excrement from the diaper. Once diaper diving occurs the excrement often ends up on furniture, clothing, hair, walls, carpeting, or other items which the diaper wearer has access to. Diaper diving is performed by various groups of individuals including, but not limited to: typical children in an infant or toddler stage, special-needs individuals of any age range. Additionally, some special needs individuals, as they begin to develop more hormones, may participate in self-stimulation and public clothing removal.

Diaper diving and self-stimulation can have numerous adverse effects for the individual as well as those other individuals in the vicinity. This conduct can result in the individual being excluded from activities and areas even though the individual does not understand the problem associated with the conduct. For those surrounding individuals, such as caregivers, friends, or family, the conduct can result in frustration, illness, and a reduced ability to perform other activities where the conduct is frowned upon. Additionally, caregivers and family members are often required to clean up the excrement which can be difficult and very horrible.

SUMMARY OF THE DISCLOSURE

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept(s) in any way.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

The present inventive concepts disclose an apparatus for preventing accessing diaper interiors, or diaper diving, in individuals who are required to wear diapers. The disclosed technology prevents access to diaper contents from both the waist region and the leg openings.

Prevention of access through the waist region is provided by a securable belt which travels through an internal tunnel around the front of the diaper cover, at the top edge of the diaper cover. The belt is accessible from the rear by a second person, such as a caretaker, but not by the wearer of the diaper. Access to the belt by the wearer is prevented by using a flap that covers the belt and is releasably secured below the belt through the use of fasteners including snaps and Velcro.

Access to diaper contents through the pant openings is prevented through the use of tight fitting closures that extend below the diaper. Elastic closures or other suitable tight fitting devices including but not limited to belts, buckles, straps, drawstrings, cord locks, and Velcro can be used to prevent diaper access through the pant openings.

DESCRIPTION OF CERTAIN PREFERRED EMBODIMENTS

Figure 1:
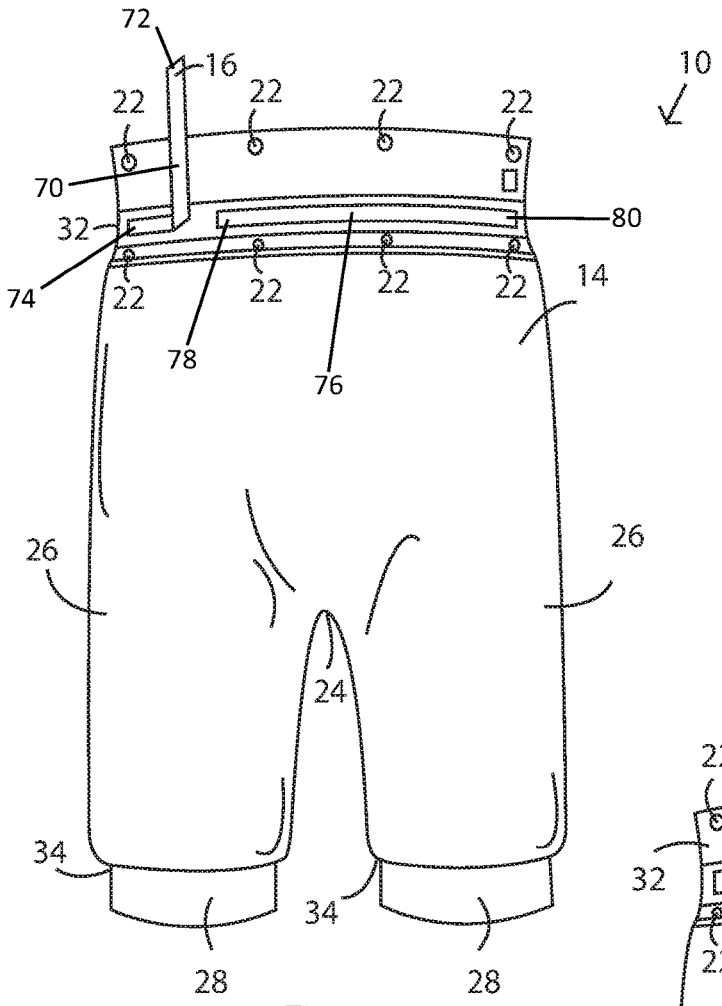
FIG. 1 is a rear view of a preferred embodiment having an unsecured hook-and-loop fastening system for the belt system and the flap being unsecured.

While the presently disclosed technology susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

FIG. 1 illustrates a rear view of diaper cover 10. Diaper cover 10 covers a diaper worn by a wearer, and prevents a wearer from accessing diaper contents through either the waist 32 or leg openings 34. Access through leg openings 34 is prevented by using tight fitting clothing options below the leg openings of the underlying diaper. Shown in FIG. 1 are ribbing leg closures 28 to prevent the wearer from reaching inside diaper cover 10. Other possible devices include belts, Velcro, straps, drawstrings, cord locks, snap closures, elastic, hook and eye, or other similar devices. The leg closures operate by fitting tight enough around the wearer's legs to prevent a hand from passing between the closure and the user's leg.

Access through waist opening 32 is prevented by utilizing an adjustable belt system. This system is preferably made by using a belt tunnel 30 that is located on the circumference of waist 32, with an opening in the rear of diaper cover 10, allowing for securing of the belt behind the wearer. The fastening system can be by use of belt drawstrings, or other devices capable of being secured around a waist, with a preferred embodiment being a Velcro connection on a flat belt material or grosgrain. The belt can also be affixed at one end such as the Velcro being sewn onto the diaper cover 10 exterior with the other end of the belt having Velcro sewn to it, being free to attach to that fixed Velcro. In one alternative embodiment, the adjustable belt system can be made by attaching two separate belt segments to the rear of diaper cover 10 at opposing sides with the separate belt segments, then attaching the belt ends to each other to tighten and secure the diaper cover 10. This belt system and its two separate belt segments include a first belt section 70, with a first belt section with a first end 72 and a second end 74, with the first end of the first belt section attached to an outer side of the back side of said garment body at a point of attachment, and a second belt section 76 with a first end 78 and a second end 80, with the first end of the second belt section attached to an outer side of the back side of the garment body opposite the point of attachments of the first belt section, wherein the second end of the first belt section and the second end of the second belt section are connectable to each other 82 on the back side of the garment.

In order to prevent access to belt 16, diaper cover 10 uses a flap 20 to cover the rear access of the belt. Flap 20 is sewn into place above belt 16 so that flap 20 can fold down and over belt 16. Flap 20 is secured in a down position covering Velcro belt 16 by snaps 22. Snaps 22 are placed on the flap with corresponding snap 22 placed below Velcro belt 16 in order to secure flap 20 over Velcro belt 16. Snaps 22 could also be Velcro or other similar releasable attachment methods including zippers, buckles, hooks, hook and eye, buttons or magnets.

Figure 2:
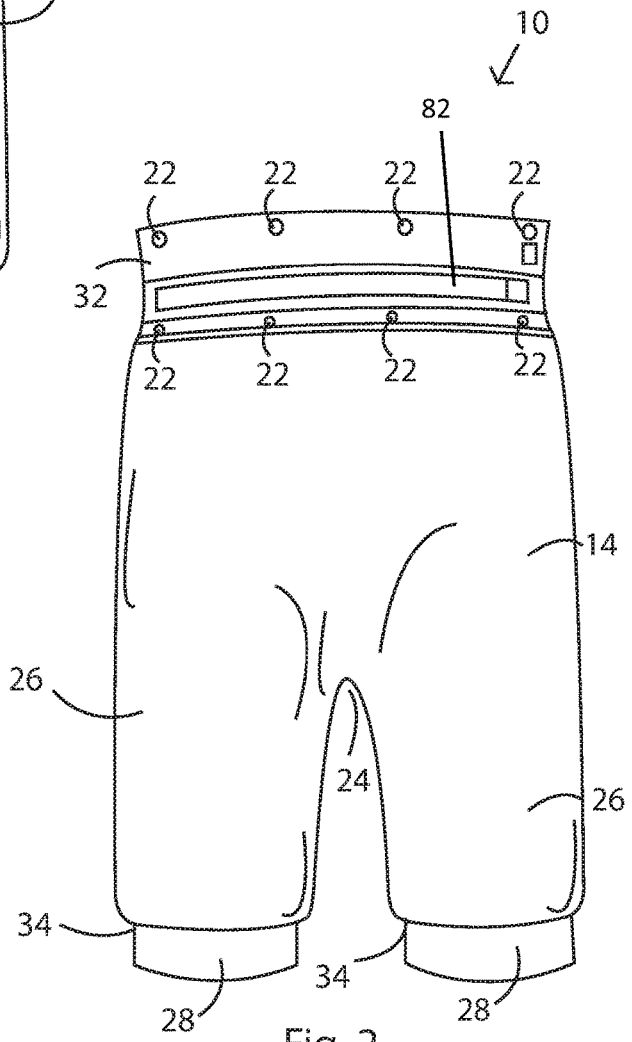
FIG. 2 is a rear view of a preferred embodiment having a secured hook-and-loop fastening system for the belt system and the flap being unsecured.

FIG. 2 shows a rear view of diaper cover 10 where Velcro belt 16 is attached to opposing belt 18. At this point, flap 20 can be folded over and secured using snaps 22. Ribbing leg closures 28 are shown extending below pant legs 26. Ribbing leg closures 28 could be shorter than pant legs 26 as long as ribbing leg closures 28 extend below the leg openings on the underlying diaper.

Figure 3:
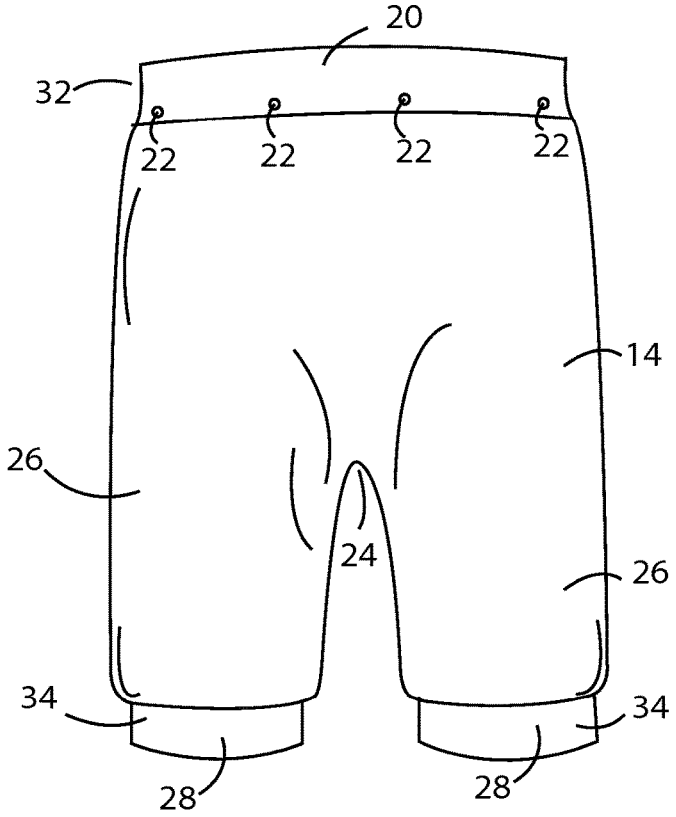
FIG. 3 is a rear view of a preferred embodiment having a secured hook-and-loop fastening system for the belt system and the flap being secured.

FIG. 3 shows a rear view of diaper cover 10. In this view Velcro belt 16 has been attached to Velcro belt 18 and covered by flap 20. Flap 20 has been secured in place by snaps 22 to cover the attachment area of Velcro belt 16 to belt 18. Elastic leg closures 28 extend below the length of pant legs 26, but having pant legs 26 longer than elastic leg closure 28 is within the scope of the disclosure.

Figure 4:
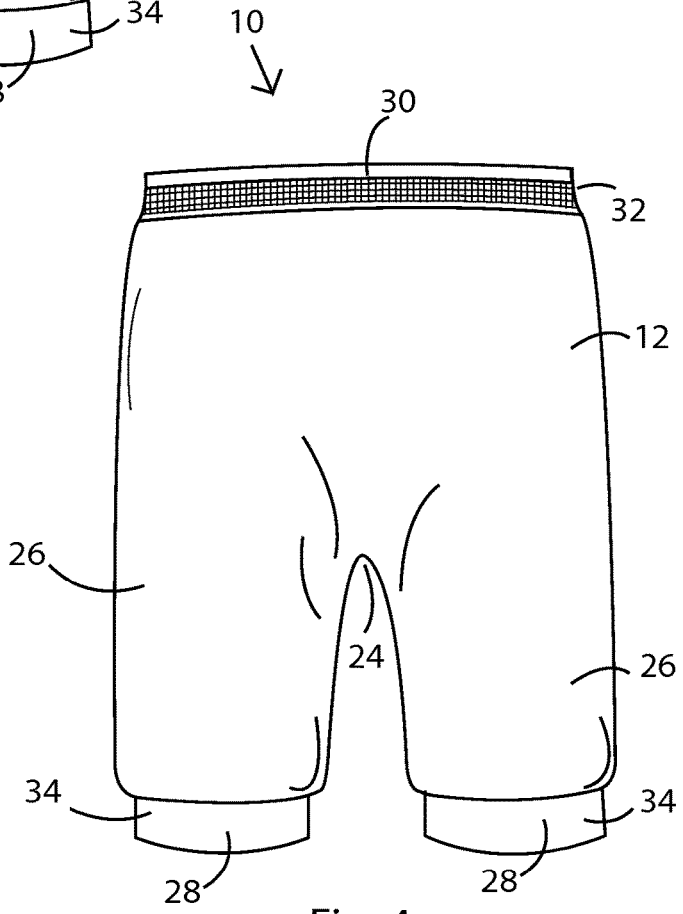
FIG. 4 is a front view of the preferred embodiment having the belt system and flap secured. The belt is not visible from outside in the front view.

FIG. 4 shows a front view of diaper cover 10. FIG. 4 shows the belt tunnel 30 passing around the waist 32 of a wearer. In this configuration a wearer cannot readily access diaper contents or the Velcro belt 16 in order to subsequently gain access to diaper contents. FIG. 4 also shows elastic leg closures 28.

Figure 5:
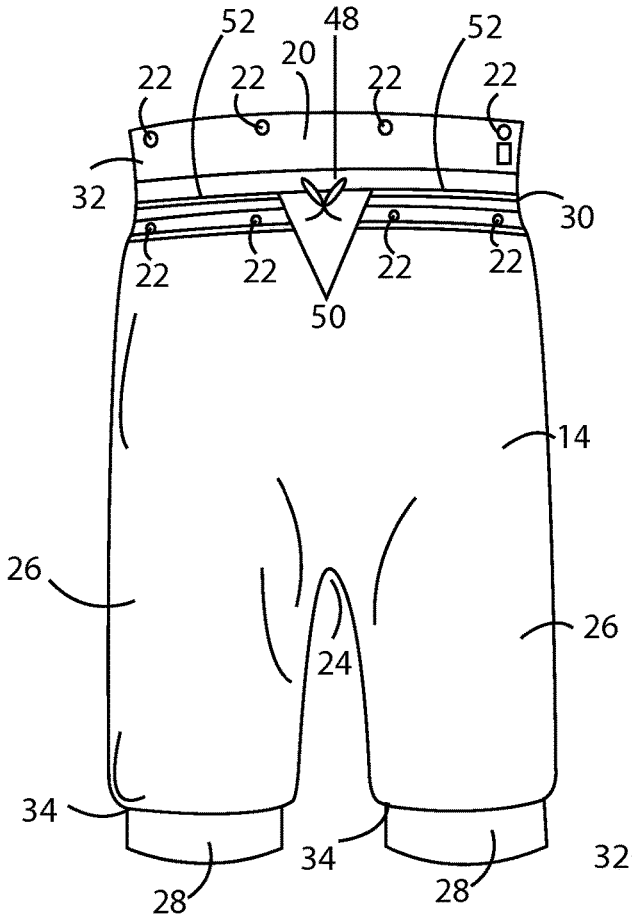
FIG. 5 shows a rear view of diaper cover with a drawstring closure.

FIG. 5 shows a rear view of diaper cover 10. FIG. 5 shows the use of drawstring 48 to tighten the waist 32 to prevent access to diaper contents by a wearer. Drawstring 50 travels into drawstring holes 50, around a wearer's waist 32 through drawstring tunnel 52, and then out of a second drawstring hole 50 and can be tied in a bow-knot or secured through other means. Once tied, access to drawstring 48 by the wearer is prevented by folding down flap 20 and securing flap 20 by utilizing snaps 22.

Figure 6:
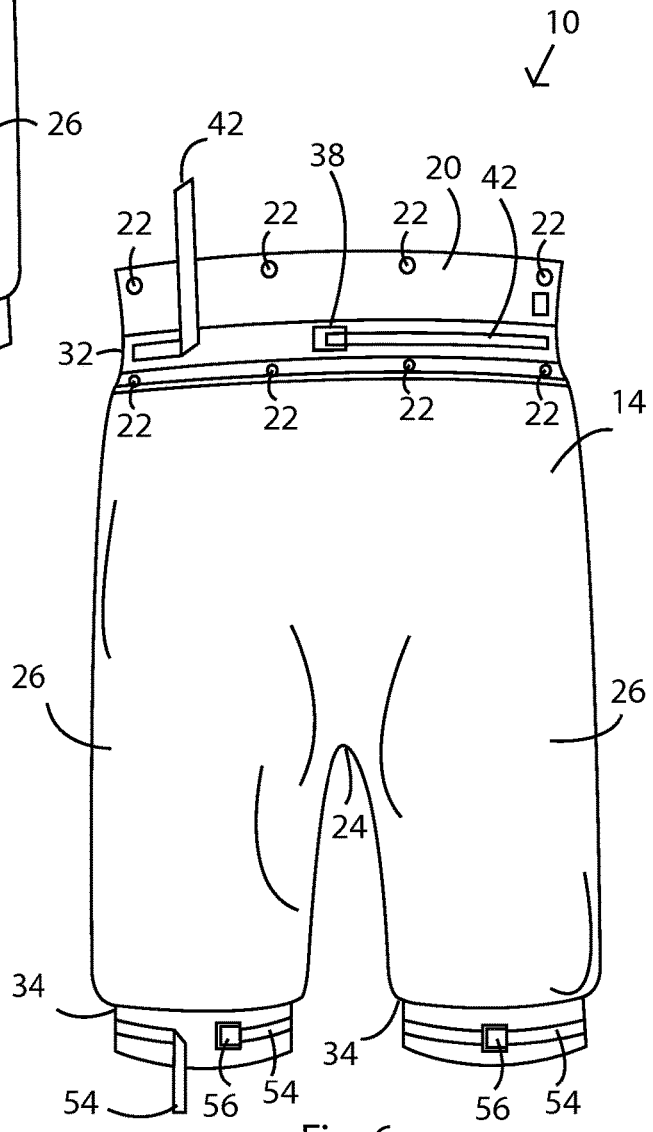
FIG. 6 shows a rear view of diaper cover with a flat webbing belt traveling through the belt tunnel.

FIG. 6 shows a rear view of diaper cover 10. FIG. 6 shows a flat webbing belt 42 traveling through belt tunnel 30, around a wearer's waist, and a compatible belt buckle 38 attached to the opposite end of flat webbing belt 42. Once flat webbing belt 42 is appropriately tightened and secured with belt buckle 38, flap 20 is folded down and over flat webbing belt 42 and flap 20 is secured using snaps 22. Also shown is one alternative embodiment, the use of a belt secures the leg openings from access by a wearer. A flat webbing belt 54 is shown utilizing buckle 56 to tighten flat webbing belt 54 in order to prevent access by a wearer to diaper contents.

Figure 7:
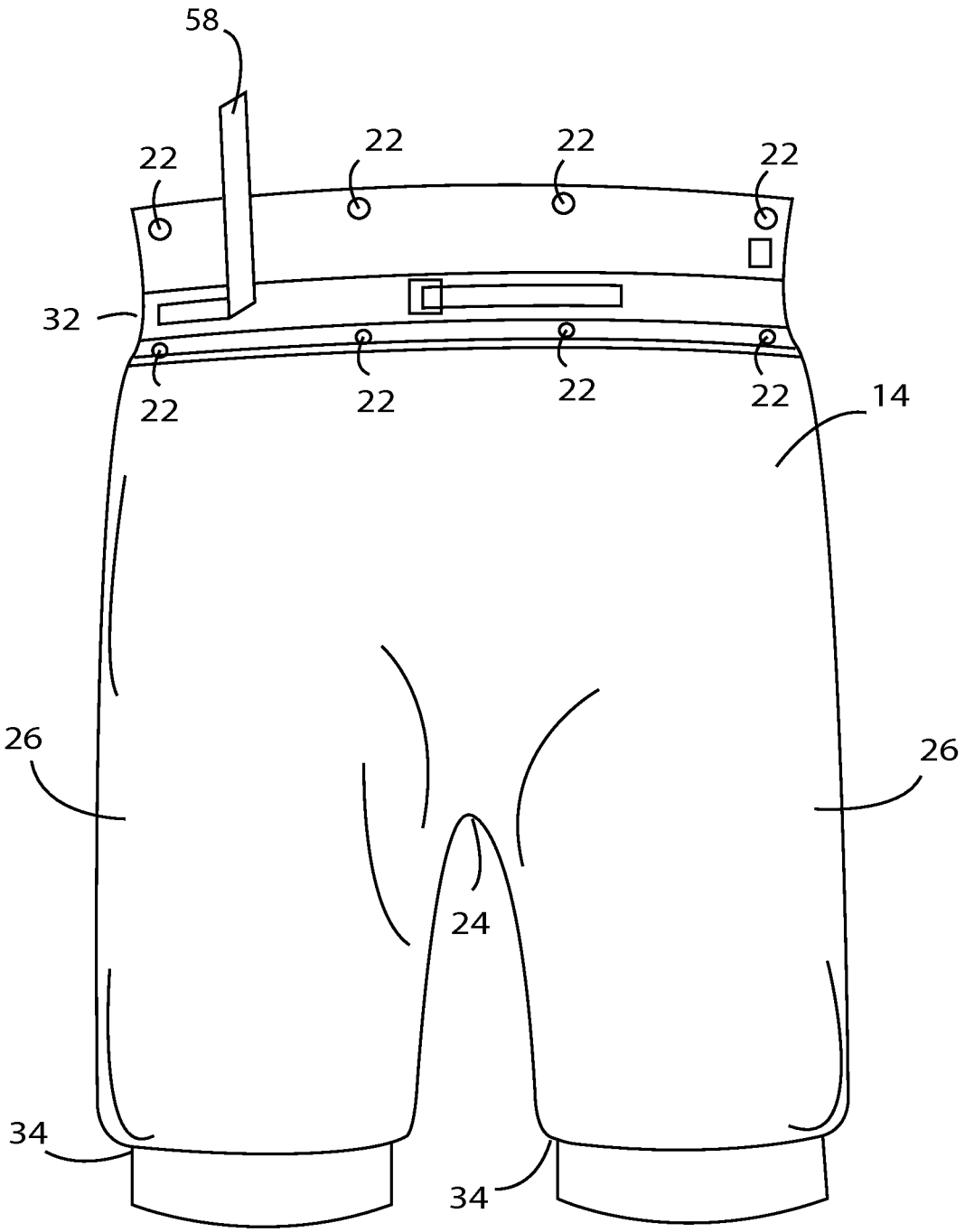
FIG. 7 shows a rear view of diaper cover with a belt end which is affixed to the back of the diaper cover at the waist.

FIG. 7 shows a rear view of diaper cover 10. FIG. 7 shows belt end 58, which is affixed to the back of diaper cover 10 at the waist 32. Also attached to the back of diaper cover 10 at waist 32 is buckle 60. Buckle 60 is configured to accept and secure belt end 58 at a desired tension. Once belt end 58 is secured to buckle 60, flap 20 is folded over belt end 58 and secured using snaps 22.

While certain exemplary embodiments are shown in the Figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. A diaper cover comprising:

a garment body having a front side configured to cover a user's front and waist region and a back side configured to cover a user's back and waist region, said garment body further comprising a waist band adjacent a top edge of said garment body, wherein said waist band is configured to define a circumference configured to encircle a user's waist;

said garment body further comprising a crotch region and adjacent to said crotch region a pair of pant legs having pant leg openings configured to be closely fitting to a wearer's leg;

said garment body further comprising a belt with a first belt end and a second belt end, with said first belt end and said second belt end configured for closing and securing said belt on said back side of said garment body, with said first belt end and said second belt end configured to join in the center of said back side; and said garment body further comprising a flap on said back side of said garment, said flap being closeable and securable over said belt to prevent access to said belt by a wearer, wherein said flap comprises a length extending parallel to said waistband, wherein said length is configured to extend the width of the entire back side of the user.

2. The diaper cover of claim 1 wherein said belt surrounds said waist region of said garment body, and said garment body comprises a belt tunnel along said waist band, with a belt opening, for passage of said belt out of said belt tunnel, said belt opening located on the back side of said garment body, with the belt being adjustable and securable on the back side of said garment body.

3. The diaper cover of claim 1 wherein said belt comprises a first piece and a second piece of belt-like material separately affixed to said waist band on said back side of said garment body; said first piece and said second piece being configured to attach together and adjustably tighten said top edge of said garment body.

4. The diaper cover of claim 1 wherein said belt is securable by an attachment on the back side of said garment body.

5. The diaper cover of claim 1 wherein said belt is securable by an attachment on the opposing end of said belt.

6. The diaper cover of claim 1 wherein said flap comprises at least one closure device to secure said flap to said garment body.

7. The diaper cover of claim 1 wherein said belt is comprised of a first belt section, with a first end and a second end, with said first end of said first belt section attached to an outer side of said back side of said garment body at a point of attachment, and a second belt section with a first end and a second end, with said first end of said second belt section attached to an outer side of said back side of said garment body opposite the point of attachment of said first belt section, wherein said second end of said first belt section and said second end of said second belt section are connectable to each other on said back side.

8. The diaper cover of claim 1 wherein said pant leg openings further comprise belt closures.

9. The diaper cover of claim 1 wherein said pant leg openings further comprise ribbing material.

10. The diaper cover of claim 1 wherein said belt is made of flat webbing.

11. The diaper cover of claim 1 wherein said belt is a drawstring.

12. The diaper cover of claim 1 wherein said belt is securable by hook and loop fasteners.

13. The diaper cover of claim 1 wherein one end of said flap is securable by one or more snaps attached to said flap corresponding to one or more snaps on said back side of said garment body.

14. The diaper cover of claim 1 wherein said length of said flap is approximately ½ of said circumference.

15. A diaper cover comprising:

a garment body having a front side and a back side configured for wearing by a user with said back side covering the rear side of a user and said front side covering the user's front and a waist region comprising a waist band surrounding a top edge of said garment body, wherein said waist band is configured to define a circumference around a user's waist;

said garment body further comprising a crotch region and adjacent to said crotch region a pair of pant legs having pant leg openings configured to be closely fitting to a wearer's leg;

a belt made up of a first belt section, with a first end and a second end, with said first end of said first belt section attached to an outer side of said back side of said garment body at a point of attachment, and a second belt section with a first end and a second end, with said first end of said second belt section attached to an outer side of said back side of said garment body opposite the point of attachment of said first belt section, wherein said second end of said first belt section and said second end of said second belt section are connectable to each other on said back side; and said garment body further comprising a flap on said back side of said garment, with said flap being closeable and securable over said belt to prevent access to said belt by a wearer, said flap has a length of approximately ½ of said circumference configured fora wearer's back side.

* * * * *